US006966196B2

(12) United States Patent
Matsuki et al.

(10) Patent No.: US 6,966,196 B2
(45) Date of Patent: Nov. 22, 2005

(54) REFRIGERATION UNIT USING AMMONIA

(75) Inventors: Kensuke Matsuki, Tokyo (JP); Takashi Nemoto, Tokyo (JP); Tsutomu Kikuchi, Tokyo (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 53 days.

(21) Appl. No.: 10/747,253

(22) Filed: Dec. 30, 2003

(65) Prior Publication Data

US 2005/0138947 A1 Jun. 30, 2005

(51) Int. Cl.[7] ..... F28D 5/00
(52) U.S. Cl. ..... 62/305; 62/228.1; 62/434
(58) Field of Search ..... 62/305, 434, 229, 62/228.1, 228.3, 430

(56) References Cited

U.S. PATENT DOCUMENTS 6,253,566 B1 * 7/2001 Ichikawa et al. ..... 62/434
6,332,335 B1 * 12/2001 Kajimoto et al. ..... 62/434
6,418,749 B2 * 7/2002 Ichikawa et al. ..... 62/434
6,532,755 B2 * 3/2003 Ichikawa et al. ..... 62/228.3

* cited by examiner

*Primary Examiner*—Melvin Jones
(74) *Attorney, Agent, or Firm*—Crowell & Moring LLP

(57) ABSTRACT

A refrigeration unit using ammonia aimed to reduce the amount of charged ammonia, and to establish a measure to render leaked ammonia gas harmless, is provided. The ammonia chiller unit comprises a compressor, a compressor driving motor, an evaporation type condenser, an expansion valve, an evaporator to perform refrigerating cycle using ammonia as a refrigerant. The unit is composed of a lower construction body comprising a compressor, a motor for driving the compressor, a control board, a brine cooler to function as an evaporator, a brine pump, a water tank, a sprinkler pump, etc., and an upper construction body comprising a drain pan and an evaporation type condenser located above the drain pan. The evaporation type condenser is composed of a multitubular heat exchanger having at both end sides an inlet and outlet headers, ammonia refrigerant flowing in one direction, and the multitubular heat exchanger is incline downward from the inlet side toward the evaporator.

5 Claims, 8 Drawing Sheets

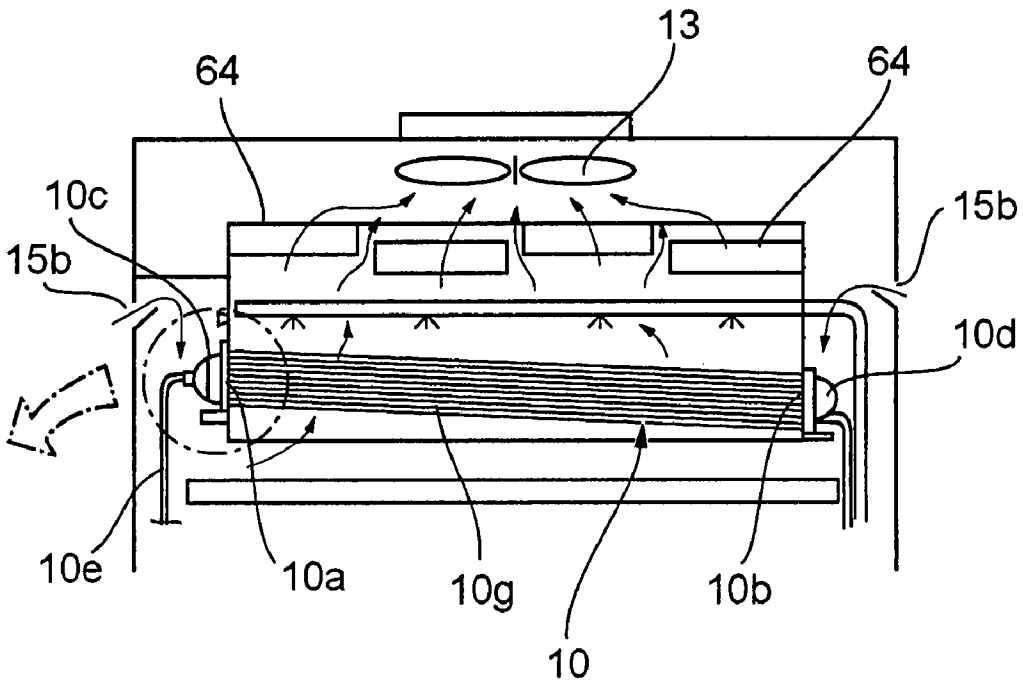
Fig.6 ( A )
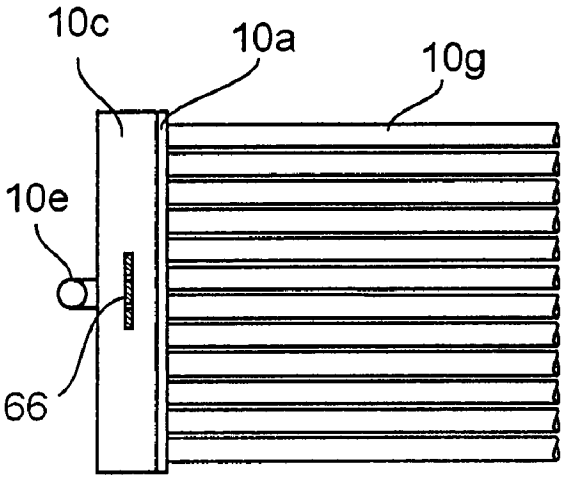
Fig.6 ( B )
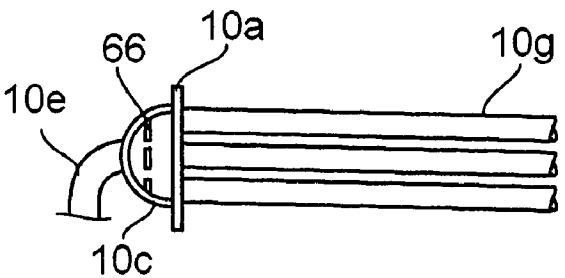
Fig.6 ( C )

REFRIGERATION UNIT USING AMMONIA

BACKGROUND OF THE INVENTION

1. Field of the invention

The present invention is related to a refrigeration unit using ammonia (an ammonia chiller unit) for small-scale refrigeration in a refrigerator, goods handling room, processing room, etc., the unit comprising a compressor, evaporation type condenser, expansion valve, brine cooler(evaporator) to perform a refrigerating cycle using ammonia as a refrigerant.

2. Description of the Related Art

In recent years measures for preventing ozone layer destruction and global warming are strongly demanded. In the field of air conditioning and refrigeration, it is urgently demanded not only not to use CFC refrigerant from the viewpoint of preventing ozone layer destruction but also to reclaim alternative refrigerant HFC and achieve improvement in energy efficiency from the viewpoint of preventing global warming.

To respond to the demands, natural refrigerants such as ammonia, hydrocarbons, air, carbon dioxide, etc. are being considered for use as refrigerants. Ammonia refrigerant is being adopted in many large-scale chilling/refrigerating plants. Furthermore, use of ammonia, a natural refrigerant, is tending to increase also in the field of small-scale chilling/refrigerating plants.

Ammonia refrigerant used for said chilling/refrigerating plants has advantages that the ozone layer destruction effect index is zero, greenhouse effect index is 1, the plant is low priced, COP is high, heat transfer coefficient is high, critical temperature and pressure are high, detection of leakage is easy, choking of expansion valve does not occur, refrigeration effect is high, etc. and drawbacks that the refrigerant is toxic, is soluble to water to be reduced to corrosive substance, is not soluble to oil, temperature at the compressor outlet is high, copper group material can not be used, etc.

Therefore, to use safely ammonia as a refrigerant, following things are required in addition that operators are conversant with safe handling method of ammonia to secure safety.

These are, first to reduce the amount of charged ammonia to a minimum, then to establish the system to be leakproof, to compose equipments constituting the system taking into consideration safety in case leakage of ammonia occurs, to improve reliability and accuracy of detecting and controlling leakage of ammonia, to prepare a measure to render leaked ammonia gas harmless. Success or unsuccess of development in the field of ammonia refrigerating machine is dependent on whether above mentioned problems are overcome and solved or not.

As a measure to reduce the amount of charged ammonia, a direct expansion type evaporation system using oil having compatibility (mutual solubility) was developed, by which the required amount of refrigerant was reduced to about 1/50 compared with that of prior types evaporation systems such as a liquid pump type and flooded system requiring a large amount of refrigerant. However, still further reduction is demanded.

As a measure to reduce the leakage of refrigerant, it is necessary to adopt a hermetically sealed or semi-sealed shaft seal of the compressor to reduce leakage from the passage of refrigerant flow. For this purpose, a compressor integrated with a canned motor, which is composed such that a highly corrosion-resistant can is provided between the rotor and stator of an electric motor to isolate the stator from an atmosphere of ammonia, has been adopted. With the compressor, ammonia gas leakage can be reduced.

As to refrigerant leakage, to positively prevent ammonia leakage from parts other than the compressor, an integral-type refrigerating machine unit has been adopted, which is a factory-fabricated packaged refrigerating machine.

Among the things to be required to secure the safety of ammonia refrigerating system mentioned before, things required further improvement are a measure to render leaked ammonia gas harmless and a further increase in operation efficiency of the refrigerating machine unit.

SUMMARY OF THE INVENTION

The present invention was made in light of the problems mentioned above, and an object of the invention is to provide a refrigeration unit using ammonia with improved safety by improving structurally the unit to cancel the drawbacks of ammonia refrigerant.

Another object of the present invention is to provide a refrigeration unit using ammonia with reduced pressure loss of the cooling air flow through eliminators when the unit is constructed to be equipped with an evaporation type condenser.

The present invention proposes a refrigeration unit using ammonia comprising a compressor, a compressor driving motor, an evaporation type condenser, an expansion valve, and an evaporator to perform refrigerating cycle using ammonia as a refrigerant, wherein said compressor driving motor, said compressor, a control board, a brine cooler which works as an evaporator, a brine pump, a water tank, a sprinkler head pump, etc. are located in the lower construction body of upper and lower construction bodies; an evaporation type condenser structure is located above a drain pan in the upper construction body; said evaporation type condenser is constructed to be a multitubular heat exchanger having an inlet side header and an outlet side header, ammonia refrigerant flowing in one direction; and said multitubular heat exchanger is inclined downward toward the evaporator from the inlet side header where the compressed refrigerant is introduced into.

That is, the invention is a refrigeration unit using ammonia composed of two construction bodies; the lower construction body includes a compressor driving motor, a compressor, a control board, a brine cooler as an evaporator, a brine pump, a water tank, and a sprinkler pump, and the upper construction body includes a drain pan partitioning the two sections, and an evaporation type condenser.

The evaporation type condenser is constructed such that the heat exchanger is of a multitubular heat exchanger with the tubes inclined downward from the upstream side inlet header to the downstream side header of the heat exchanger instead of a conventional heat exchanger with a hairpin coil. High-pressure, high-temperature refrigerant gas is introduced in the upstream side header, the refrigerant gas is cooled to be condensed to a liquid state refrigerant during the gas flows down in the inclined tubes to the downstream side header by the cooling air and sprinkled water flowing through between the outer peripheries of the inclined cooling tubes. A film of liquid refrigerant is formed on the inner wall of the inclined cooling tubes in the process of cooling. The film of liquid refrigerant is allowed to flow downward due to the inclination of the tubes, so the average thickness of the film is kept thin without stagnating on the inner wall of the tube. As a result, the heat transfer across the walls of the tubes is enhanced.

Accordingly, the one of the objects of the present invention to attain efficient condensation is accomplished by composing the evaporation type condenser to have inclined tubes. By the configuration like this, the size of the evaporation type condenser can naturally be reduced resulting in a reduction of the amount of refrigerant retained in the evaporation type condenser.

It is preferable to compose the evaporation type condenser which is a main component of the ammonia chiller unit such that; the evaporation type condenser structure is constructed to be composed of a multitubular heat exchanger having headers at both sides thereof, a sprinkler head disposed above the cooling tubes of the heat exchanger, a bottom side open type condensing section with said heat exchanger and sprinkler head integrated therein and with a cooling air introducing opening provided at the lower part thereof, an outside casing to form a double-shelled space around said condensing section, and cooling fan or fans disposed above the condensing section to send the cooling air to outside; an air inlet opening is provided on the outer casing at the position equal to or higher than the position facing to the cooling pipes; and outside air sucked from the air inlet opening flows downward in the space between the outside casing and the condensing section to be introduced to said air introducing opening provided at the lower part of the condensing section.

Studies were made on measures to effectively render harmless the ammonia gas leaked from the compressor, compressor driving motor, evaporator, expansion valve, and water tank, etc. located in the lower construction body and on the taking-in of the cooling air for condensing the high-pressure, high-temperature ammonia gas. According to the result of the studies, it was decided to compose such that the outer casing is provided outside of the condensing section consisting of the evaporation type condenser and water sprinkler head to form said double-shelled space surrounding the condensing section. Leaked ammonia gas is gathered in the upper part of the double-shelled space and brought out of there together with the cooling air sucked from the air intake openings provided at the upper part of the outer casing. The leaked ammonia gas is dissolved in the water sprinkled from the sprinkler head located above the heat exchanger to be rendered harmless. The high-pressure, high-temperature ammonia gas flowing in the inclined cooling tubes is cooled by said cooling air and sprinkled water to be condensed.

The condensing section of the evaporation type condenser is included inside the double-shell construction above the drain pan which defines the boundary of the lower construction body including the machinery of the chiller unit and the upper construction body including the evaporation type condenser and the drain pan. The evaporation type condenser consists of an inclined multitubular heat exchanger, sprinkler head, and the cooling fan or fans for sending out the cooling air introduced from the opening provided in the bottom part of the condensing section after it cools the refrigerant in the tubes.

The outer casing is provided arround the condensing section of a cuboidal space with bottom part open provided above the drain pan to surround the cuboidal condensing section doubly in order to form a space surrounding the condensing section.

A plurality of inclined tubes are attached to the tube supporting end plates which constitute a pair of side walls opposing to each other of the condensing section to compose the inclined multitubular heat exchanger.

As mentioned above, the sprinkler head is located above the heat exchanger to allow cooling water to be sprinkled from the sprinkler head onto the inclined cooling tubes. The ammonia gas is cooled in the tubes by the latent heat of evaporation of the sprinkled water and air for enhancing the evaporation of the sprinkled water is introduced to the condensing section from the bottom opening thereof and released to outside by the cooling fan provided above the sprinkler head.

The cooling air is taken in from the intake openings provided in the outer casing to form said double shell, i.e. the outer wall of the double surrounding walls of the condensing section.

Two kinds of outside air intake openings are provided, that is, air intake openings for taking in outside air to transport leaked ammonia together with the air for rendering the leaked ammonia harmless provided in both sides of the outer casing at the upper part facing the headers of the inclined multitubular heat exchanger, and air intake openings for taking in cooling air provided in both sides of the outer casing facing the inclined cooling tubes of the heat exchanger at the position level with or higher than the lowest position of the inclined cooling tubes.

The outside air taken in from the air intake openings flows downward in the space between the condensing section and outer casing to be introduced to the bottom opening of the condensing section, performs the cooling of refrigerant and the rendering of leaked ammonia gas harmless, then released to outside by the cooling fan.

The ammonia gas leaked from the machinery in the lower construction body flows upward through the space between the drain pan and outer casing to the double-shelled space between the condensing section and outer casing. The leaked ammonia gas flowed in the double-shelled space is introduced to the bottom opening of the condensing section by the outside air taken in from the air intake openings for taking in air for rendering the leaked ammonia harmless provided in the uppermost part of the outer casing, the ammonia is dissolved in the sprinkled water to be rendered harmless, and the water solution of ammonia is received in the drain pan, thus the leaked ammonia gas can be rendered harmless always completely.

It is preferable that the drain pan is shaped like a shallow funnel having a downward inclined bottom and the drain pan is fixed to the outer casing with its peripheral wall.

The above invention is concerned with the configuration of the drain pan. The bottom of the drain pan located directly above the water tank in the lower construction body is inclined toward the outlet thereof like a shallow funnel so that the water flows smoothly toward the outlet without stagnating in the drain pan. The drain pan is fixed to the outer casing with its peripheral wall to prevent the water splashed on the drain pan from falling into the lower construction body.

It is preferable in the present invention that the ammonia refrigerator compressor side is located in a closed unit space, on the other hand the evaporation type condenser for condensing the compressed ammonia gas compressed by the ammonia refrigerator compressor is located in an open space side; the condenser is composed of a heat exchanger consisting of inclined cooling tubes, a sprinkler head, a plurality of eliminators arranged in parallel to each other, and a fan or fans; and said eliminators arranged in parallel to each other are positioned such that the eliminators adjacent to each other are positioned to be different in height so that the upper part of the side wall of an eliminator faces the lower part of the side face of its adjacent eliminator.

According to the invention like this, as the upper part of the side face of a lower eliminator faces the lower part of the side face of its adjacent upper eliminator, the length of the side face of the adjacent eliminators facing to each other is decreased. Therefore, flow resistance between adjacent eliminators can be reduced even if the gap between the eliminators adjacent to each other.

The water droplets produced by the sprinkler head impinge against the side wall of the lower eliminator positioned adjacent to the upper eliminator, and the droplets grow large. The large droplets are less apt to be sucked by the fan, therefore the flying of the droplets upward can be prevented.

Further, by constructing the heat exchanger to be an inclined multitubular heat exchanger having a header connected to an inlet to introduce compressed ammonia gas, and providing a baffle plate in the header at the position facing an inlet for introducing compressed ammonia gas, the ammonia gas introduced from said inlet collides against said baffle plate and flows evenly in the inclined cooling tubes.

As has been described in the foregoing, the present invention is effectual as described in the following:

The reduction of the amount of charged ammonia is attained by applying the inclined multitubular heat exchanger for the evaporation type condenser of the ammonia chiller unit, in which liquid refrigerant film developed on the inner wall of the cooling tube is thin in average because the stagnation of the film is prevented owing to the downward inclination of the cooling tubes and heat transfer through the wall of the tube is enhanced, and as a result the amount of ammonia refrigerant to be retained in the tubes for required cooling can be reduced.

Safety operation of the chiller unit is possible since the unit is provided with always effective means for rendering leaked ammonia gas harmless and the measure to prevent the sprinkled cooling water from splashing out of the unit.

The flow resistance (pressure loss) of the cooling air sucked by a fan or fans to flow through eliminators is reduced in the case an ammonia chiller unit is composed using an evaporation type condenser and a plurality of eliminators are arranged between the condensing section and the fan or fans.

BRIEF DESCRIPTION OF THE DRAWINGS

FIG. 6(A) is an illustration of the arrangement of eliminators above the evaporation type condenser of the ammonia chiller unit shown in FIG. 8 when the eliminators are efficiently positioned, FIG. 6(B) is a plan sectional view of the header part surrounded with ○ in FIG. 6(A), and FIG. 6(C) is a side sectional view thereof.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
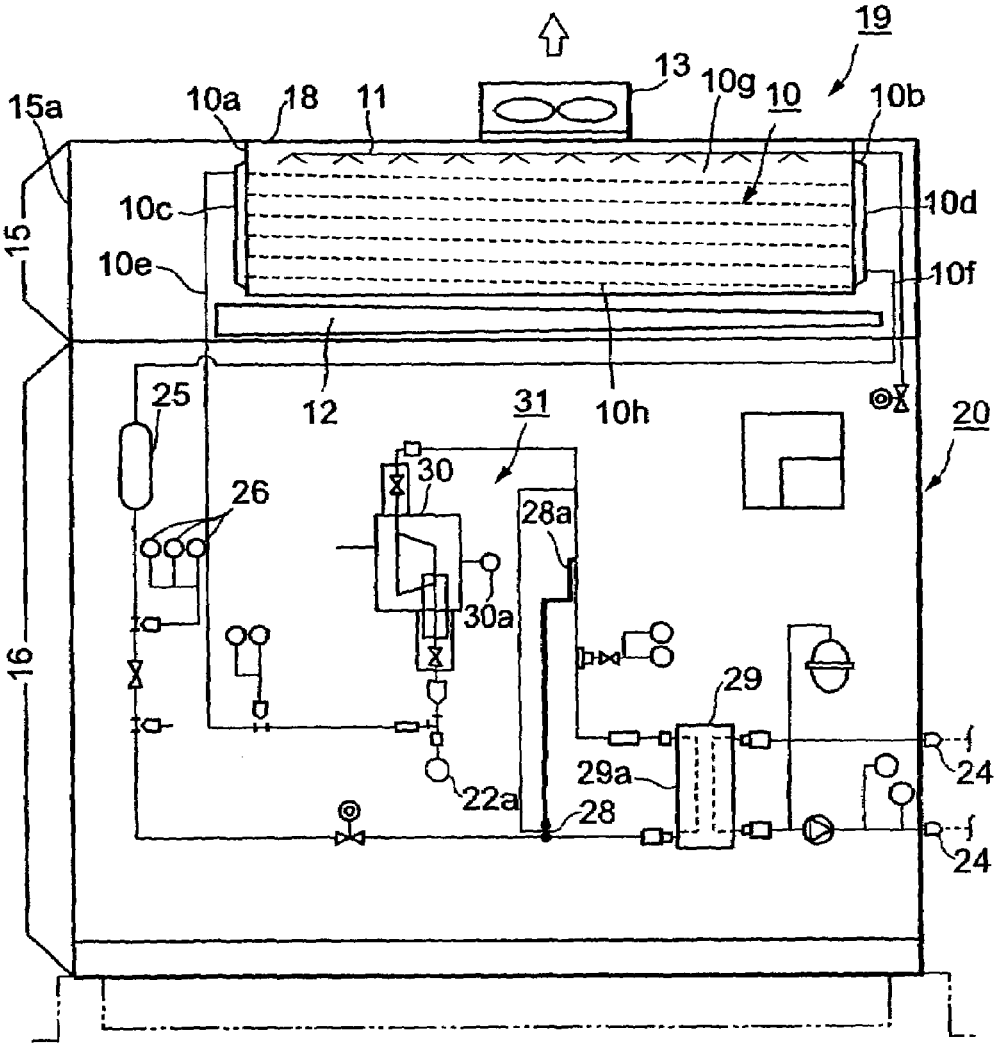
FIG. 1 is a schematic illustration of the system of the ammonia chiller unit according to the present invention provided with the evaporation type condenser.
Figure 2:
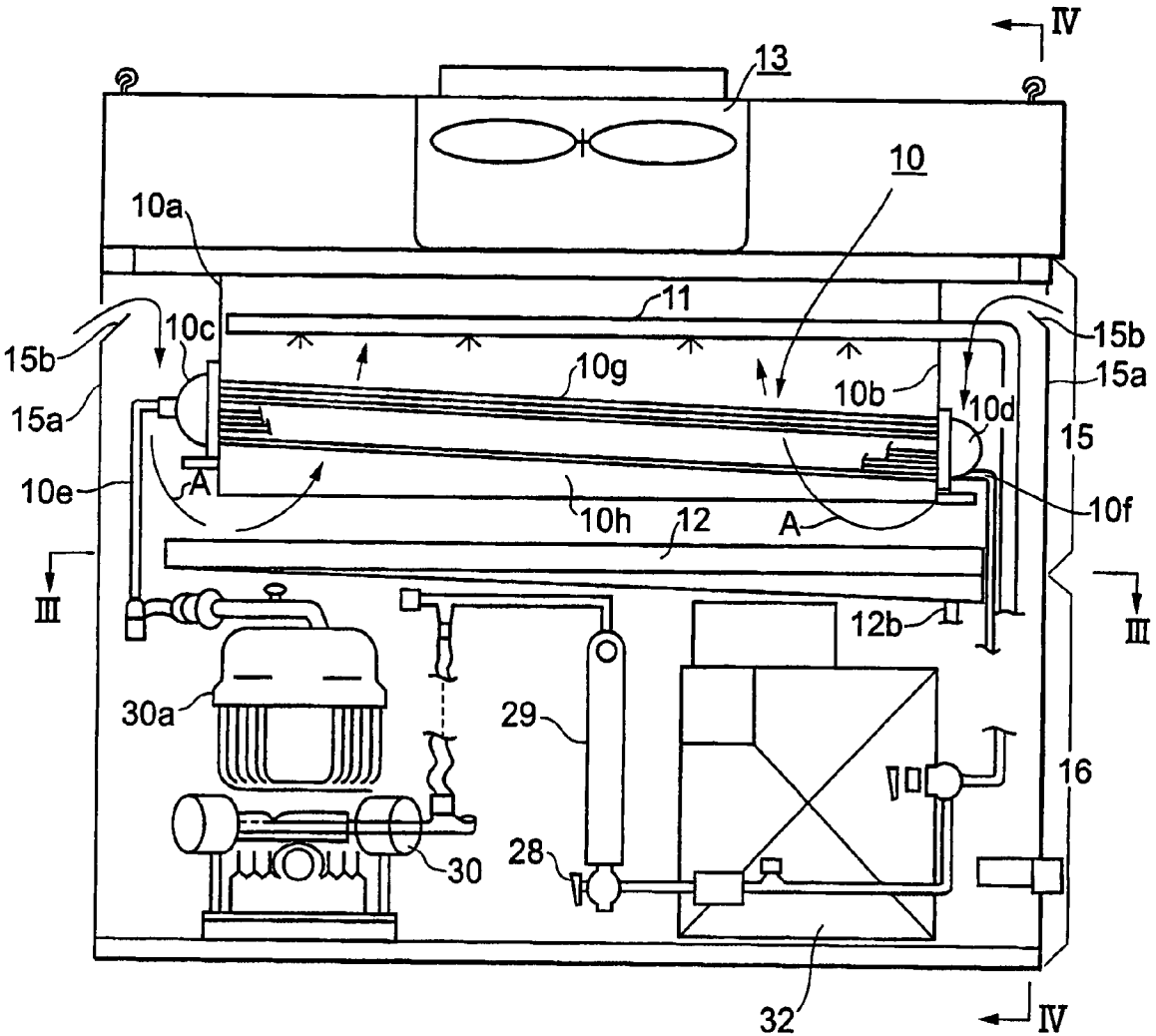
FIG. 2 is an illustration showing the inner configuration of the ammonia chiller unit of FIG. 1.
Figure 3:
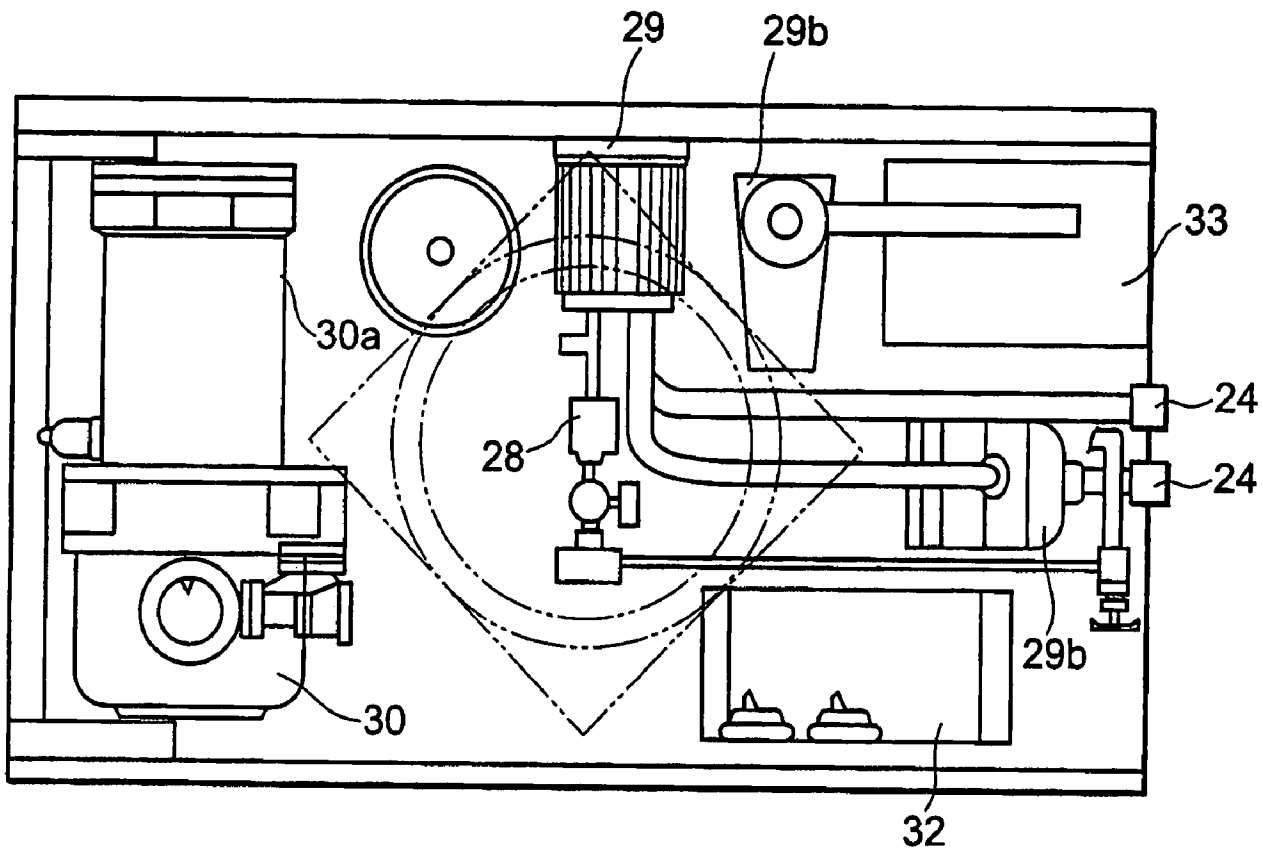
FIG. 3 is a view along line III—III in FIG. 2.
Figure 4:
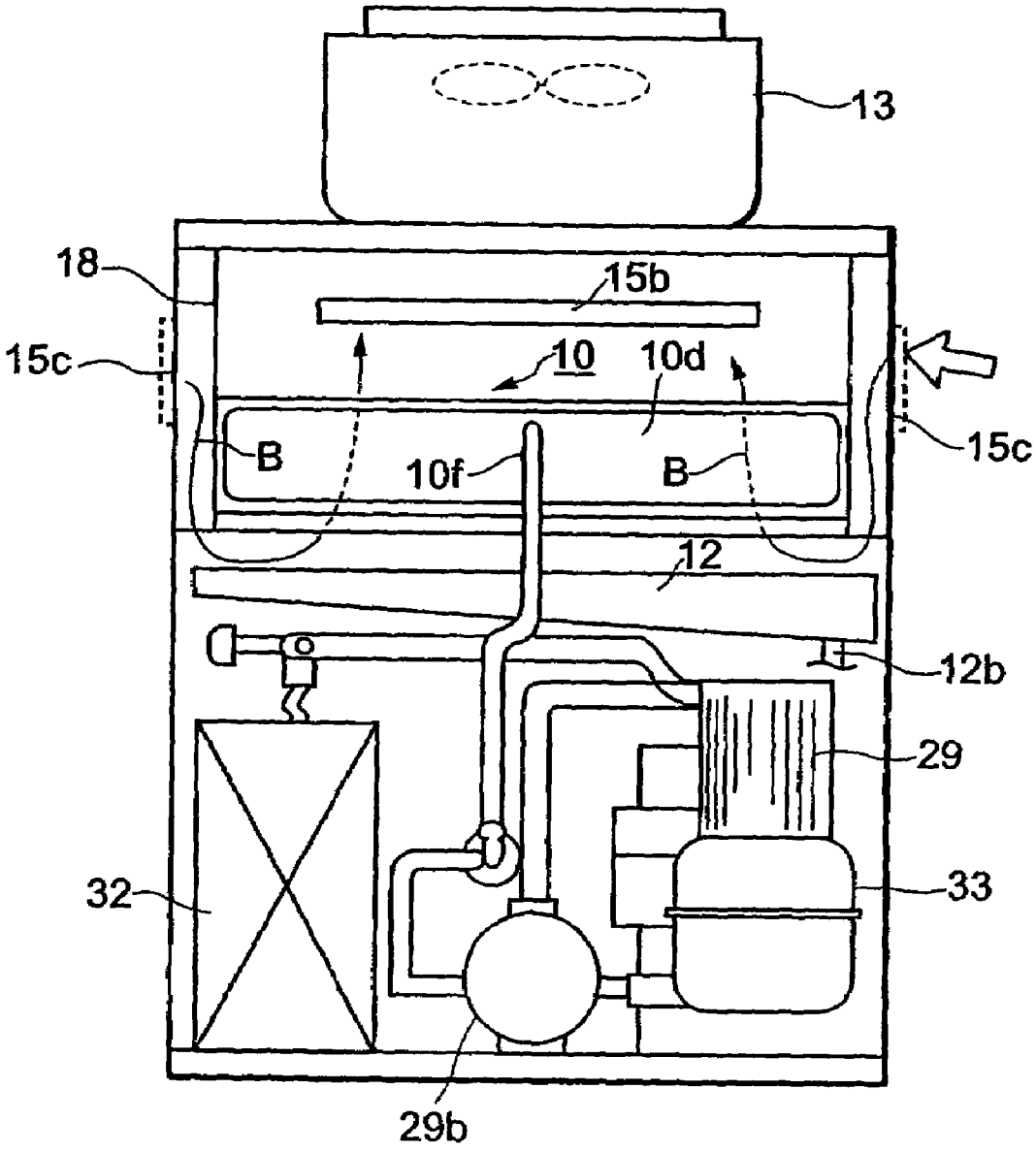
FIG. 4 is a view along line IV—IV in FIG. 2.

FIG. 1 is a schematic illustration of the system of the ammonia refrigerating machine unit according to the present invention provided with the evaporation type condenser, FIG. 2 is an illustration showing the inner configuration of the ammonia refrigerating machine unit of FIG. 1, FIG. 3 is a view along line III—III in FIG. 2, and FIG. 4 is a view along line IV—IV in FIG. 2.

Figure 5:
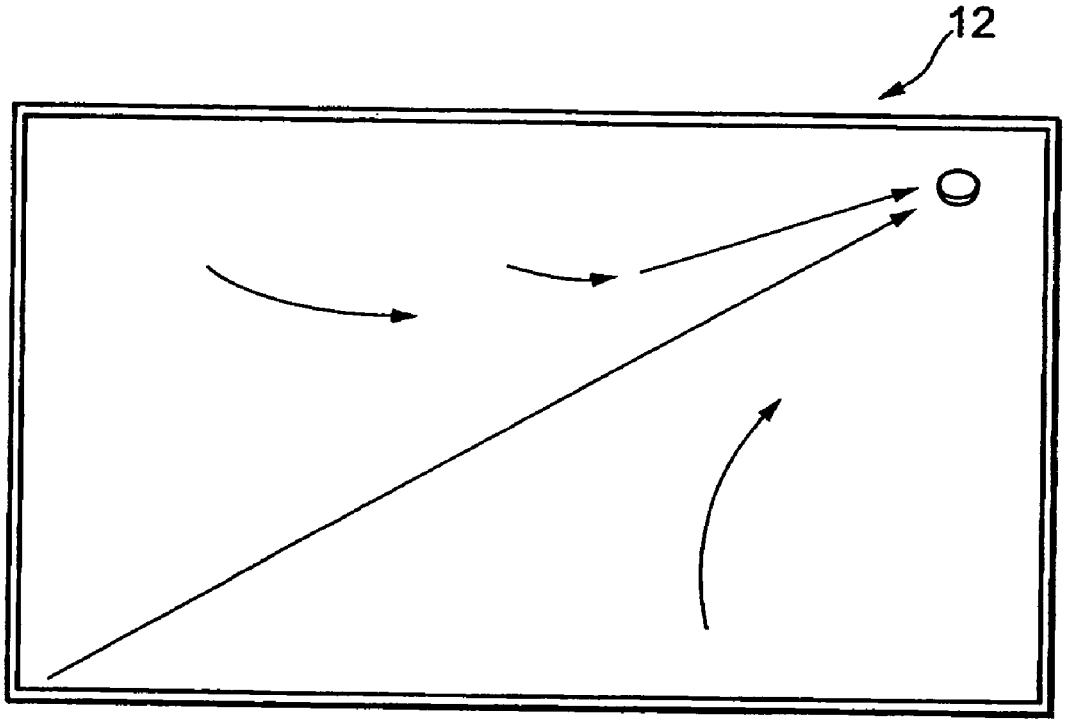
FIG. 5(A) is a top plan view of the drain pan.
FIG. 5(B) is a sectional view of the drain pan.
Figure 5B:
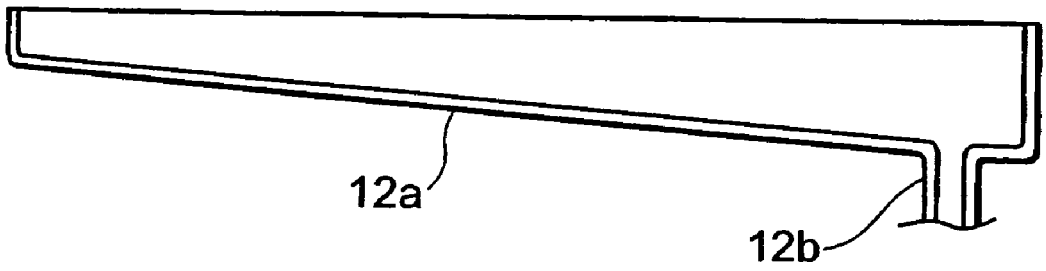

FIG. 5(A) is a top plan view of the drain pan, and FIG. 5(B) is a sectional view of the drain pan.

The ammonia chiller unit according to the present invention as shown in FIG. 1 is located outdoors, the cold heat(cryogenic temperature) produced by the unit is transferred to loads located indoors not shown in the drawing by means of a brine which is chilled by a brine cooler 29, the brine leaving and entering the brine cooler 29 from an outlet and inlet opening 24, 24.

The ammonia chiller unit 20 is of two-staged construction body composed of a lower construction body 16 and an upper construction body 15.

The lower construction body 16 comprises an integral type compressor 31 with a motor integrated therewith composed of a motor 30*a* and a compressor 30, an automatic expansion valve 28, a brine cooler 29, a water tank 33, a sprinkler head pump 29*b*, and a control board 32 (see FIG. 4) covered by a lower outer casing. The upper construction body 15 comprises a drain pan 12, an evaporation type condenser 19, a condensing section 18, and an outer casing 15*a*.

Said two-staged construction body is produced in a factory as a factory-fabricated unit, and only brine piping work and electric wiring work are necessary to be done at the install site of the unit. The constituent parts of the unit are standardized parts produced under precise control.

The integral type compressor 31 is composed of the compressor 30 and motor 30*a* integrated with the compressor 30, and the motor 30*a* is of a hermetically sealed or semi-sealed structure from which ammonia does not leak out.

The evaporation type condenser 19 is, as shown in FIG. 1, FIG. 2, and FIG. 4, composed of an inclined multitubular heat exchanger 10, a water sprinkler head 11, a condensing section 18 in which the heat exchanger 10 (including tube end plates 10*a* and 10*b*) and the sprinkler head 11 are located, and a cooling fan 13.

Said inclined multitubular heat exchanger 10 comprises a plurality of inclining cooling tubes 10*g* which penetrate the upright tube end plates 10*a* and 10*b* to connect the space in the header 10*c* and 10*d* of the heat exchanger 10, the tubes being inclined downward from the inlet side header 10*c* toward the outlet side header 10*d*.

Refrigerant gas introduced into the inlet side header 10*c* is condensed to a liquid state refrigerant in the process of flowing toward the outlet side header 10*d* by the cooling with cooling air and sprinkled water as mentioned later. Due to the inclination of the tubes 10*g*, the liquid films formed on the inner walls of the tubes 10*g* move toward the outlet header 10*d* without remaining at rest on the walls.

Accordingly, refrigerant gas condenses under high heat transfer coefficient in said inclined cooling tubes, and residence period of the refrigerant in the heat exchanger can be reduced. Therefore, improvement in condenser efficiency and substantial reduction in the amount of charged refrigerant can be attained.

The water sprinkler head 11 is located above the inclined multitubular heat exchanger 10 and sprinkles atomized water from above the inclined cooling tubes 10*g*. The water evaporates on the surface of the inclined cooling tubes 10*g* and the high-pressure, high-temperature ammonia gas introduced into the cooling tubes 10*g* is cooled mainly by the latent heat of evaporation of the water.

A part of the water not evaporated passes across the cooling tubes to reach the drain pan 12 provided under the heat exchanger 10 and introduced to the water tank 33 located in the lower construction body 16 by way of a drain pipe 12*b* (see FIG. 2, FIG. 4) and stored therein.

Said condensing section 18 is a cuboidaly partitioned space with its bottom open, where the inclined multitubular heat exchanger 10 is located with the sprinkler head 11 provided above it. The cooling fan 13 located above the sprinkler head 11 sucks air from the opening 10*h* of the condensing section 18 and the air cools the cooling tubes 10*g* together with the sprinkled water, the cooling is enhanced by the cooling air crossing through the bundle of cooling tubes 10*g*.

The outer casing 15*a* is provided to form a double-shelled space between itself and the condensing section 18, and said cooling air is introduced from air inlet openings 15*c*, 15*c* located on the outer casing 15*a* at the position level with or above the higher side end of the downward inclining cooling tubes 10*g*. Outside air is sucked by the cooling fan 13 from the air inlet openings 15*c*, 15*c*. The sucked air is changed in direction downward as shown with arrows B, then again changed in direction to enter the opening 10*h* to flow through the bundle of the tubes 10*g* to cool them, and released to the atmosphere as shown in FIG. 4.

Each of said cooling air inlet openings 15*c*, 15*c* is formed to have an opening area as large as possible because of the necessity to introduce a large amount of air, covered with a net, and positioned on the outer casing at the part level with or above the position where the inclined cooling tubes face to the outer casing in order to prevent the water droplets splashed from the drain pan to fly off outward.

Additional air inlet openings 15*b*, 15*b* are provided on the outer casing 15*a*, as shown in FIG. 2, on the sides facing the pipe end supporting plates 10*a*, 10*b* at the position upper than said end plates 10*a*, 10*b*, specifically at the position level with or a little upper than the sprinkler head 11, each opening 15*b*, 15*b* being provided with an upward slanting guide. Outside air is sucked from each of the inlet openings 15*a*, 15*b*. The sucked air is changed in direction downward as shown by arrow A to guide the leaked ammonia gas residing in the upper part of the double-shelled space to the opening 10*h* provided below the condensing section 18, whereby turned in direction upward to be flow through the bundle of the tubes 10*g* to cool them and released to the atmosphere passing through the cooling fan 13. The leaked ammonia gas sucked together with outside air is dissolved in the sprinkled water and rendered harmless. As said means for rendering leaked ammonia gas harmless is always working during operation, the cooling unit can meet the contingencies of ammonia gas leakage.

The drain pan 12 to receive the water falling from the sprinkler head 11 is located under the condensing section 18 and forms the boundary between the lower construction body 16 and the upper construction body 15. The drain pan 12 is shaped like a shallow funnel having the bottom inclined toward drain pipe 12*b* as shown in FIG. 5(A) and FIG. 5(B) in order to allow the cooling water falling from the sprinkler head 11 to flow as shown with arrows in FIG. 5(A) down to the water tank 33 located in the lower construction body section.

The drain pan is fixed to the outer casing 15*a* with its peripheral wall to prevent the water splashed on the drain pan from falling into the lower construction body.

An automatic expansion valve 28 shown in FIG. 1 is provided before a brine cooler 29 which is located downstream from a receiver 25 provided on a refrigerant line 10*f* downstream from the evaporation type condenser 19, and a direct evaporation type evaporation of refrigerant is performed through said automatic expansion valve 28 and said brine cooler as an evaporator.

The highly pressurized liquid refrigerant from the evaporation type condenser 19 is depressurized by the expansion valve 28 to be introduced to a mixture of low-temperature, low-pressure liquid and gaseous refrigerant, the mixture flows through the evaporation part 29*a* while evaporating and exchanging heat with the brine supplied to the brine cooler 29. The brine is cooled and the refrigerant is heated to a superheated refrigerant steam at the exit of the evaporation part. The superheated refrigerant steam is sucked by the compressor 30.

The flow rate of the refrigerant through the evaporation part 29*a* is controlled to be kept at an adequate degree of superheat through detecting the temperature of the refrigerant steam at the exit side of the evaporation part by a temperature sensor and controlling the opening of the automatic expansion valve to control the flow rate of the refrigerant automatically.

With the direct expansion type, the amount of refrigerant used can be largely reduced to about 1/50 of the amount used in a conventional ammonia refrigerating machine, and safety is expected to be markedly improved compared with a liquid pump type or flooded system conventionally used in a refrigerating cycle using ammonia refrigerant.

A pressure switch 26 shown in FIG. 1 for controlling the operation of the cooling fan 13 and the flow rate of the water from the sprinkler head 11 based on detected pressure and temperature of the refrigerant flowing in the refrigerant line, is located at the high-pressure liquid refrigerant line downstream from the receiver 25, where pressure variation is small.

A discharge gas temperature switch 22*a* is provided near the discharge port of the compressor 30 for adequately controlling the operation of the integral type compressor 31 composed of the compressor 30 and compressor driving motor 30*a* in order to protect the compressor 30 and compressor driving motor 30*a* from the high temperature of the gas discharged from the compressor 30, for the temperature of the gas discharged from the compressor is high when ammonia refrigerant is used.

Figure 8:
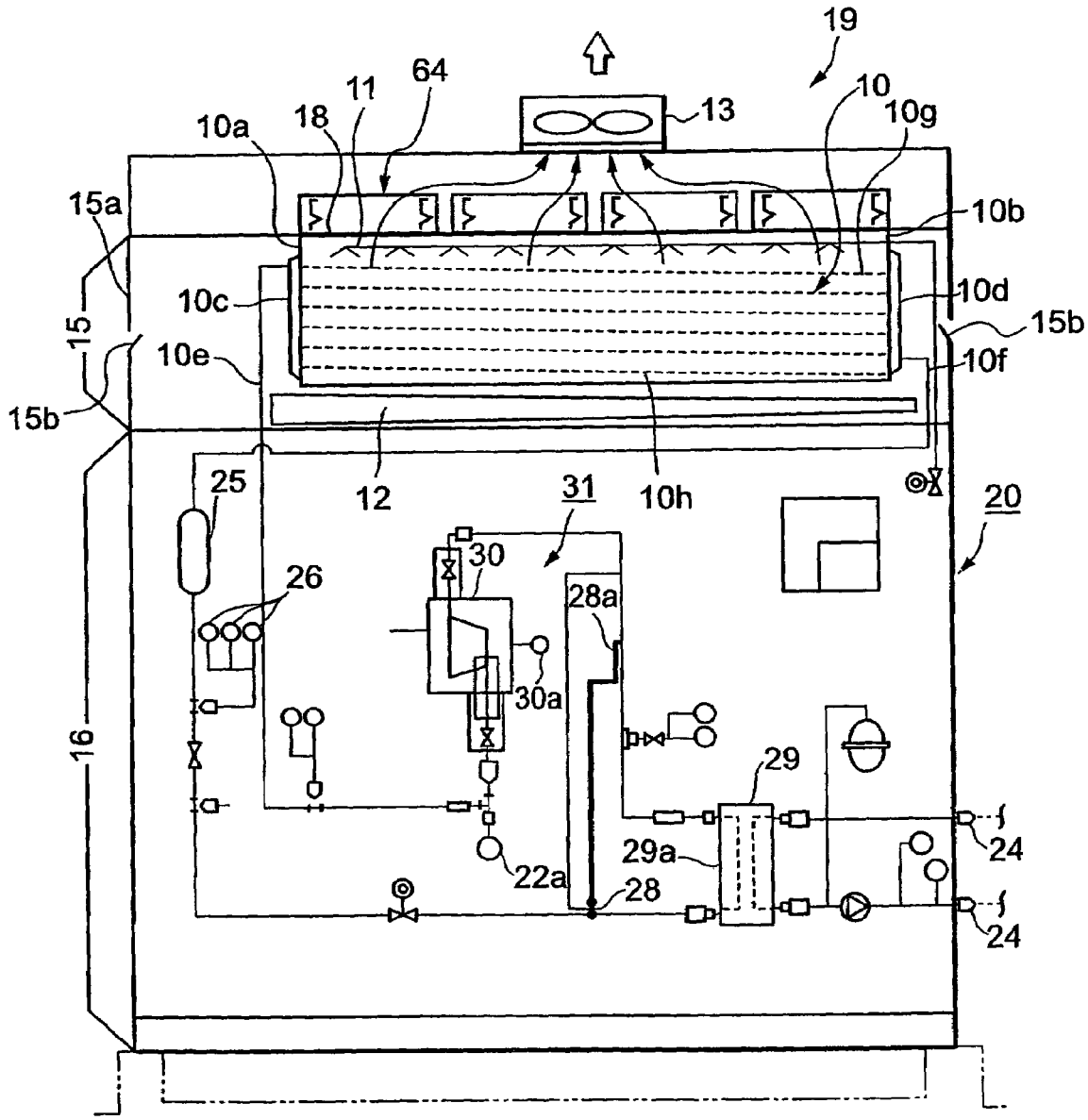
FIG. 8 is an illustration when a plurality of eliminators are arranged level with each other above the evaporation type condenser of the ammonia chiller unit of FIG. 1.

An ammonia chiller unit containing an evaporation type condenser is generally equipped with an eliminator or eliminators to prevent the sprinkled water from being released to outside accompanied by the cooling air. FIG. 8 shows the ammonia chiller unit provided with eliminators, the structure of the unit being the same as that of FIG. 1 except that eliminators 64 are provided above the sprinkler head 11 in FIG. 8.

Referring to FIG. 8, the inclined multitubular heat exchanger 10 of the evaporation type condenser 19 is composed of tube end plates 10*a*, 10*b* fitted with the headers

10*c*, 10*d*, the tube end plates forming a pair of opposing walls, and a plurality of inclined cooling tubes 10*g* passing through the tube end plates 10*a*, 10*b*. Water is sprinkled over the inclined cooling tubes 10*g* from the sprinkler head 11 provided above the heat exchanger to cool the tubes by the latent heat of evaporation of water. The air taken in from the air in-let opening 15*c* (see FIG. 4) by the suction of the cooling fan 13 provided above the eliminators 64 passes through the eliminators to be released to outside.

A plurality of eliminators 64 to prevent sprinkled water from flying outside accompanied by the cooling air, are arranged level with and adjacent to each other in FIG. 8. In this case, the flow loss(pressure loss) of the air sucked by the cooling fan 13 is considerably large, and the fan is required to deliver large sucking force, which causes an increase in driving power and noise (Air flow is indicated by arrows.)

Figure 7:
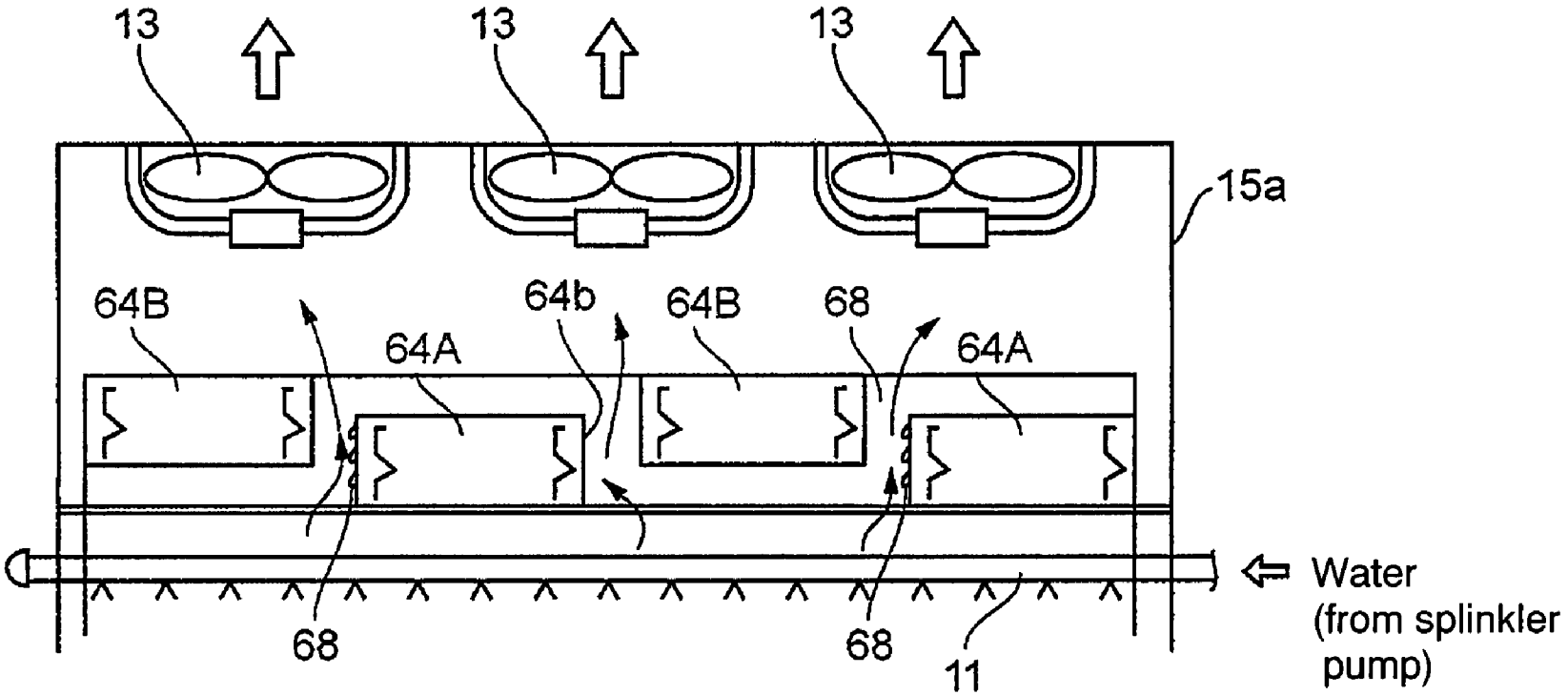
FIG. 7 is an enlarged detail of the eliminator arrangement of FIG. 6.

The inventors of this application devised a more preferable arrangement of the eliminators as shown in FIG. 6 and FIG. 7. As shown in FIG. 6, the ammonia chiller unit of the present invention is composed of two-staged construction bodies consisting of the lower construction body 16 and upper construction body 15. The lower construction body 16 contains, as mentioned before, the group of machinery constituting ammonia line with the exclusion of the evaporation type condenser and its pertinent components, and the upper construction body 15 contains the drain pan 12, evaporation type condenser 19, outer casing 15*a* and cooling fan or fans 13, etc. The evaporation type condenser 19 is composed of the inclined multitubular heat exchanger 10, sprinkler head 11, eliminators 64 arranged in step wise with each other, and cooling fan or fans 13. Leaked ammonia gas is rendered harmless by introducing the leaked ammonia gas together with the cooling air taken in from the openings 15*c* provided in the outer casing 15*a* to be introduced in the condensing section 18 from the opening 10*h* to be brought into contact with the sprinkled water to be dissolved therein. The refrigerant gas of high-pressure, high-temperature flowing through the inclined cooling tubes is cooled by the cooling air to be condensed.

The multitubular heat exchanger 10 with inclined tubes 10*g* has upright tube end supporting plates 10*a* and 10*b* at both sides, the plates 10*a* and 10*b* form the left and right side wall of the condensing section 18, the left side and right side header 10*c* and 10*d* are fixed respectively to the left and right side tube end supporting plates 10*a* and 10*b*, the inclined tubes 10*g* penetrating the tube end supporting plates.

The inlet header 10*c* fixed to the inlet side tube end supporting plate 10*a* is formed to have semi-circular cross section as shown in FIG. 6(C). Compressed ammonia gas is introduced into the inside of the inlet header 10*c* through an ammonia gas inlet port 10*e* connected to the center part of the inlet header 10*c* as shown in FIG. 6(B) and FIG. 6(C). A baffle plate 66 having a plurality of holes is attached inside the header 10*c*. The introduced ammonia gas collides against the baffle plate 66, and apart of the ammonia gas passes through the holes of the baffle plate 66 to proceed to the cooling tubes located in the rear thereof and other part of the ammonia gas is turned to left and right to be guided to enter the cooling tubes located in the remote sides from the center of the inlet port 10*e*. Thus, the ammonia gas flows uniformly in the cooling tubes 10*g*.

The drain pan 12 for receiving the cooling water from the sprinkler head 11 is located below the inclined multitubular heat exchanger and forms the boundary between the lower construction body and upper construction body. The bottom plate thereof is shaped like a shallow funnel in order to allow the cooling water fallen into the drain pan 12 to smoothly flow toward the drain pipe 12*b* without being trapped in the drain pan and then to be stored in the water tank 33 of the lower construction body.

A plurality of eliminators 64 are arranged above the sprinkler head 11 below the cooling fan or fans 13 all over the width of the outer casing 15*a*. The eliminators 64A and 64B positioned side by side are formed such that each of the eliminators is formed to be stepped with each other so that the upper part of the side wall of the eliminator 64A faces the lower part of the side wall of the eliminator 64B. The step, i.e. the distance between the bottom of the eliminator 64B and the top of the eliminator 64A is determined to be about a half of their height, concretively about 50 mm.

As a result, the water droplets 68 produced by the sprinkler head impinge against the side wall 64B of the lower eliminator 64A positioned adjacent to the upper eliminator 64B, and the droplets grow large. The large droplets are less apt to be sucked by the fan 13, therefore the flying of the droplets upward can be prevented.

In FIG. 7, an embodiment with a plurality of cooling fans arranged is shown.

What is claimed is:

1. A refrigeration unit using ammonia comprising a compressor, a compressor driving motor, an evaporation type condenser, an expansion valve, and an evaporator to perform a refrigerating cycle using ammonia as a refrigerant, wherein said compressor driving motor, said compressor, a control board, a brine cooler which works as an evaporator, a brine pump, a water tank, and a sprinkler head pump are located in the lower construction body of upper and lower construction bodies; an evaporation type condenser structure is located above a drain pan in the upper construction body; said evaporation type condenser is a multitubular heat exchanger having an inlet side header and an outlet side header, with ammonia refrigerant flowing in one direction; and said multitubular heat exchanger is inclined downward toward the evaporator from the inlet side header where compressed ammonia refrigerant is introduced.

2. The refrigeration unit using ammonia according to claim 1, wherein said evaporation type condenser is composed of a multitubular heat exchanger having headers at both sides thereof, a sprinkler head disposed above the cooling tubes of the heat exchanger, a bottom side open type condensing section with said heat exchanger and sprinkler head integrated therein and with a cooling air introducing opening provided at the lower part thereof, an outside casing to form a double-shelled space around said condensing section, and at least one cooling fan disposed above the condensing section to send the cooling air to outside; an air inlet opening is provided on the outer casing at the position equal to or higher than the position facing to the cooling pipes; and outside air sucked from the air inlet opening flows downward in the space between the outside casing and the condensing section to be introduced to said air introducing opening provided at the lower part of the condensing section.

3. The refrigeration unit using ammonia according to claim 1, wherein the drain pan is shaped like a shallow funnel having a downward inclined bottom and the drain pan is fixed to the outer casing with its peripheral wall.

4. The refrigeration unit using ammonia according to claim 1, wherein said upper construction body includes the drain pan and the evaporation type condenser located above the drain pan; said condenser is composed of a heat exchanger consisting of cooling tubes, a sprinkler head, a plurality of eliminators arranged in parallel to each other, and at least one fan; and said eliminators arranged in parallel to each other are positioned such that the eliminators adjacent to each other are positioned to be different in height so that the upper part of the side wall of an eliminator faces the lower part of the side face of its adjacent eliminator.

5. The refrigeration unit using ammonia according to claim 1, wherein said heat exchanger is an inclined multi-tubular heat exchanger having a header connected to an inlet to introduce compressed ammonia gas, and a baffle plate is provided in the header at the position facing said inlet for introducing compressed ammonia gas.

* * * * *